United States Patent [19]

Roberts

[11] Patent Number: 4,692,211

[45] Date of Patent: Sep. 8, 1987

[54] HIGH STRENGTH, CELLULOSIC-GEL-CONTAINING KRAFT PAPER AND PROCESS FOR MAKING THE SAME

[75] Inventor: James R. Roberts, Palatine, Ill.

[73] Assignee: Eucatex S.A. Industria é Comercio of Sao Paulo, São Paulo, Brazil

[21] Appl. No.: 868,881

[22] Filed: May 23, 1986

Related U.S. Application Data

[63] Continuation of Ser. No. 661,977, Dec. 12, 1984, abandoned, which is a continuation of Ser. No. 417,874, Sep. 14, 1982, abandoned.

[51] Int. Cl.[4] ..... D21H 5/12; D21H 3/20

[52] U.S. Cl. ..... 162/147; 162/149; 162/176; 162/187

[58] Field of Search ..... 162/187, 176, 147, 149

[56] References Cited

U.S. PATENT DOCUMENTS

| | | | |
|---|---|---|---|
| 2,096,976 | 10/1937 | Richter et al. | 162/187 |
| 4,077,833 | 3/1978 | Roberts | 162/187 |
| 4,309,247 | 1/1982 | Hou et al. | 162/187 |

*Primary Examiner*—Peter Chin

*Attorney, Agent, or Firm*—Eugene D. Farley

[57] ABSTRACT

High strength, cellulosic-gel-containing kraft paper is made by mechanically refining kraft papermaking pulp to a freeness of CSF 500–800, mixing the resulting refined pulp with from 1 to 10% hydrated cellulosic gel binder, running the resulting fluid mixture into a felted sheet and pressing and drying the sheet to form the kraft paper product.

6 Claims, No Drawings

HIGH STRENGTH, CELLULOSIC-GEL-CONTAINING KRAFT PAPER AND PROCESS FOR MAKING THE SAME

This application is a continuation of application Ser. No. 661,977, filed Dec. 12, 1984, the same being a continuation of Ser. No. 417,874, filed Sept. 14, 1982, both abandoned.

BACKGROUND AND GENERAL STATEMENT OF THE INVENTION

This invention pertains to high strength, cellulosic-gel-containing kraft paper and to a process for making the same.

In a typical procedure, cellulosic gels are prepared by feeding a chemical papermaking pulp such as a Kraft pulp to a conventional hydrapulper in which it is disintegrated into a fibrous slurry having a consistency of from 1 to 10%, preferably from 6 to 8%.

The resulting slurry is fed to a battery of several conventional pulp refiners arranged in series. The flow through the sequence of refiners is throttled down by appropriate valving to give a pressurized dwell or residence time sufficient to exhaustively hydrate the feed material and produce a hydrated cellulosic gel product.

The use of cellulosic gels prepared in this manner as binders in the manufacture of wet process composition boards of various categories is illustrated in the following patents:

| | | |
|---|---|---|
| Roberts U.S. 3379608-9 | Roberts | 4173248 |
| Roberts U.S. 4043862 | Heritage Canada | 449167 |
| Roberts U.S. 4077833 | | |
| Roberts U.S. 4087317 | | |

However, cellulosic gels heretofore have not been applied successfully as efficient binders in the manufacture of Kraft papers since it appeared that the physical properties of the gels would prohibit their successful application to this end use.

Papermaking machines operate at very high speeds, for example, at speeds of as much as 3500 feet per minute. It is necessary that the furnish supplied to them drain quickly through the wire, i.e. in a matter of seconds.

Cellulosic gels are thick, viscous, sticky liquids. It would seem self-evident that to include a significant proportion of them in a papermaking furnish, in order to improve the strength of the paper product, would increase the drain time of the furnish to such a level as to make it unsuitable for use on high speed paper machines. Accordingly, heretofore the desired high strength of the paper products has been developed by refining the pulp to a high degree, and by using long fibered stock which inherently imparts high strength to the paper. This is undesirable, since prolonged refining requires expensive equipment the use of which is attended by high power costs. Long fibered stocks are comparatively expensive. Substantial economies could be achieved by reducing the refining time and using short fibered stocks, for example, short fibered hardwood stocks.

I have discovered that, surprisingly, the inclusion of a substantial proportion of cellulosic gel in Kraft papermaking furnishes does not materially increase their drain times on the Fourdrinier wire. Additionally, their inclusion materially increases the strength of the paper and reduces significantly the refining time which must be applied to the freshly cooked pulp.

Accordingly it is the general object of my invention to provide a process which will result in the production of Kraft papers of improved quality at significantly lower cost.

A further object of my invention is the provision of a process for the production of Kraft papers of improved strength, and having smoother, harder surfaces.

Another object of my invention is the provision of a process for making kraft papers which permits the inclusion of a significant amount of low cost, short fibered pulp such as hardwood pulp without adversely affecting the strength of the paper products.

Generally stated, my presently described process of making high strength kraft papers characterized by the above noted advantages comprises first mechanically refining kraft papermaking pulp to a freeness value of about CSF 500–800. Next, a fluid mixture is made of from about 90 to about 99% of the resulting refined pulp and from about 1 to about 10% of hydrated cellulosic gel binder.

The kraft papermaking pulp which is a primary component of the mixture comprises from about 40 to about 100% by weight of freshly prepared or "virgin" kraft pulp and from 0 to 60% by weight of pulp prepared from reclaimed or "secondary" lignocellulosic fibers, which may include a substantial proportion of short fibers.

The mixture is run into a felted sheet which is pressed and dried to form the final kraft paper product.

DESCRIPTION OF PREFERRED EMBODIMENTS OF THE INVENTION

As noted above, the new kraft paper of my invention broadly comprises kraft papermaking pulp and cellulosic gel.

These two materials are employed in the following general and preferred proportions, given in percent by weight, dry solids basis:

| | General | Preferred |
|---|---|---|
| Kraft papermaking pulp | 90–99 | 94–98 |
| Cellulosic gel | 1–10 | 2–6 |

The kraft papermaking pulp may be derived from the usual sources and is prepared by the sulfate pulping of the woods of various species of trees or other lignocellulosic material.

After the pulp has been removed from the digester, it is washed and screened and then subjected to a relatively brief treatment in a conventional refiner, i.e. a double disc refiner such as a Sprout-Waldron or Beloit Jones refiner. The refining need be carried out only to a limited degree, i.e. until the Canadian Standard Freeness has reached a value of from about 500 to about 800, preferably from about 600 to about 750, with consequent saving of energy.

The kraft papermaking pulp component may comprise 100% virgin pulp, prepared as outlined above, or, it may include a proportion, i.e. from 0 to 60% of its weight, dry solids basis, of pulps other than virgin kraft pulp. These secondary fibers may include fibers derived from cleaned papermaking sludge, short fibers derived from the "save all" of the paper mill, from waste paper, from waste cartons and bags, and even from sawdust.

The weakening effect of these relatively short, lower quality fibers is overcome by the reinforcing action of the added cellulosic gel.

Where the secondary fibers are derived from waste paper or waste cartons, they are converted to a pulp of papermaking consistency by processing them in a hydrapulper followed by suitable refining in a conventional deflaker or refiner to break up fiber clumps and bundles. This refined stock then is combined with the virgin pulp stock.

The gel component of the papermaking mixture comprises the exhaustively hydrated cellulosic gel described, for example, in my U.S. Pat. Nos. 4,043,862, 4,077,833, and 4,173,248.

In its manufacture, chemical cellulose pulp such as kraft cellulose pulp is refined and hydrated exhaustively to a high degree at which fiber structure is almost completely destroyed. Specifically, this is accomplished by breaking down cellulose pulp sheets to their component individual fibers and fiber clumps, preferably by adding the dry sheets and water to a conventional hydrapulper and hydrapulping at a stock consistency of from 1 to 10%, preferably from 6 to 8%. This requires about 30 minutes.

The resulting pulp then is fed in controlled flow to a selected disc-type or conical-type primary refiner. There preferably are three such refiners arranged in series with a flow-restricting valve downstream from the last refiner to insure an adequate pressurized refiner dwell time. These abrade the pulp and hydrate it to a high degree, thereby forcing water through the cellulosic structure.

The resulting partially refined and hydrated pulp is then fed to a secondary refiner of the same general class as the primary refiners, but which is effective to complete the hydration. The pulp is reduced in size to values imparting to it TAPPI standard drain times of at least 350 seconds, preferably above 900 seconds. This is accomplished by a shearing action which almost completely destroys the fiber structure of the pulp and hydrates it exhaustively. This supplemental and exhaustive refining greatly improves the qualities of the pulp as a binder, dispersing agent and retention agent when used in the manufacture of the herein described high strength paper.

In particular, it makes of the gel an "irreversible" binder. As a result, paper made with it is highly water resistant.

A method other than the TAPPI drain time test for characterizing a gel suitable for the present purpose is to determine the shrinkage upon drying of the handsheet produced by the TAPPI drain time test. A suitably hydrated gel will form a hand sheet which shrinks upon drying to a diameter which is at least 25% smaller than its original diameter.

In another method, the hand sheet is dried and a small flame applied to its underside. If the cellulose is sufficiently hydrated, this instantaneously will produce a blister in the sheet.

In still a further test procedure, 250 milleliters of the gel slurry is dried into a solid ball. If the gel is sufficiently hydrated, the ball will sink when dropped into water and thereafter will remain hard without swelling for an indefinite period of submergence.

In addition to the cellulosic gel prepared as described above, various additives may also be included in the papermaking furnish as desirable or necessary. These may include small proportions of dyes, rot-proofing agents, wet strength agents, wax, and the like.

The pulp may be bleached if desired, in which case it usually is preferred to use a bleached gel as well.

To prepare the furnish, all the foregoing materials are added to a suitable mixer such as a Waring blender and mixed to uniformity. The resulting mixture then is added to the headbox of the paper machine, and run into a felted sheet, which is pressed and dried to form the final paper product.

EXAMPLES

The process of my invention is illustrated in the following examples wherein the amounts of the constituents are given in percent by weight, dry weight basis.

A conventional kraft bag-making stock refined to a freeness of CSF 650 was mixed with about 24% by weight of pulp having a freeness of about CSF 550 and containing secondary fibers derived from hydrapulping principally corrugated kraft boxes and passing the resulting pulp through a deflaker for preliminary refining in order to break down fiber bundles and clumps. The resulting pulp mixture had a consistency of about 0.3%. It was mixed with exhaustively hydrated cellulosic gel prepared as outlined above and having a TAPPI drain time of 550 seconds and a shrinkage of 27% when subjected to the handsheet drying test.

The pulp and gel were formulated into 6 test mixtures containing respectively 0, 2, 4, 6, 8 and 10% gel.

The mixtures were run into standard test hand sheets having a weight of 200 grams per square meter. These then were tested by the Standard TAPPI Test for measuring stiffness, CSF freeness, burst, tear and tensile. The results are given in conventional TAPPI test units in the table below.

| % GEL | STIFF-NESS | FREENESS | BURST | TEAR | TENSILE |
|---|---|---|---|---|---|
| 0 | 55 | 720 | 166 | 320 | 17,1 |
| 2 | 50 | 700 | 172 | 342 | 17,6 |
| 4 | 80 | 690 | 198 | 376 | 19,3 |
| 6 | 75 | 670 | 190 | 392 | 25,1 |
| 8 | 75 | 670 | 187 | 408 | 22,7 |
| 10 | 60 | 630 | 161 | 320 | 19.8 |

Inspection of the above test data illustrates clearly that inclusion of as much as 8% gel reduces the CSF freeness but a small amount, i.e. from 720 to 670. This is not a sufficient reduction to materially increase the drain time of the furnish on the wire.

The results indicate further a significant increase in strength, for example, an increase in tensile strength of from 17.1 to 22.7.

If the gel binder were to be omitted, refining of the original virgin stock to a freeness of CSF 400 to 450 would be required to attain equivalent sheet strength, with attendant high refining costs.

Other benefits accrue from the use of cellulosic gel in the manufacture of kraft paper.

Its use permits the addition of lower cost fibers to the paper sheet without significant reduction of strength properties.

The gel can be made from a variety of fiber raw materials as well as from conventional kraft and sulfite pulp.

At 6% gel usage, with conventional pressing, it makes a thicker sheet at the same weight as the regular pulp. Accordingly a lighter weight sheet having acceptable physical properties can be made at present thicknesses.

The gel usage gives a paper sheet with a harder, smoother surface.

The reinforcing effect of the gel shows on papers made from hardwoods, soft woods, recycled paper and thermo mechanical pulp.

Use of gel in corrugating medium gives a substantial increase in compression resistance. This persists under conditions of very high humidity.

Gel is an excellent fiber retention aid. It holds onto most of the very fine fibers which normally are lost to the forming wire of the papermaking machine.

If the paper machine is improved so it will run faster, as by installing an "extended nip" or other thermal or mechanical improvements, the use of gel will permit the additional pulp needed to come from the lower cost secondary fiber sources listed above.

In sum, the use of cellulosic gel in kraft paper improves all important sheet physical properties and makes possible the production of higher quality paper at lower cost.

Having thus described my invention in specific embodiments, I claim as new and desire to protect by Letters Patent:

1. The process of making high strength kraft paper which comprises:

(a) mechanically refining kraft paper-making pulp to a freeness value of about CSF 500–800;

(b) forming a fluid mixture of from about 90 to about 99% of the resulting refined pulp and from about 1 to about 10% of hydrated cellulosic gel binder having a TAPPI drain time of at least 350 seconds, percent being expressed as percent by weight on a dry solids basis, (c) the draft paper-making pulp comprising from about 40 to about 100% by weight virgin kraft pulp and from about 0 to about 60% by weight, dry weight basis, short fibered hardwood papermaking pulp or short fibered reclaim papermaking pulp, (d) running the fluid mixture into a felted sheet and (e) pressing and drying the sheet to form the kraft paper product.

2. The process of claim 1 wherein the kraft papermaking pulp is mechanically refined to a freeness value of about CSF 600–750.

3. The process of claim 1 wherein the fluid mixture comprises from about 94% to about 98% refined pulp and from about 2% to about 6% hydrated cellulosic gel binder.

4. The process of claim 1 wherein the kraft papermaking pulp comprises substantially 100% by weight virgin kraft pulp.

5. The process of claim 1 wherein the papermaking pulp is refined to a freeness of about CSF 600–750 and the fluid mixture comprises from about 94% to about 98% refined pulp and from about 2% to about 6% hydrated cellulosic gel binder, and wherein the cellulosic gel binder has a TAPPI drain time of at least about 350 seconds.

6. The high strength, cellulosic-gel-containing kraft paper product of the process of claim 1.

* * * * *